US005334293A

United States Patent [19]

Cairns et al.

[11] Patent Number: 5,334,293

[45] Date of Patent: Aug. 2, 1994

[54] ELECTRODE COMPRISING A COATED VALVE METAL SUBSTRATE

[75] Inventors: John F. Cairns, Warrington; David R. Hodgson, Wigan, both of England

[73] Assignee: Imperial Chemical Industries Public Limited Company, London, England

[21] Appl. No.: 748,928

[22] Filed: Aug. 23, 1991

[30] Foreign Application Priority Data

Aug. 31, 1990 [GB] United Kingdom ..... 9018953

[51] Int. Cl.[5] ..... C25B 1/16; C25B 11/10

[52] U.S. Cl. ..... 204/98; 204/128; 204/290 F; 427/125; 427/126.3; 427/126.5; 427/226; 427/229; 427/419.3; 427/404

[58] Field of Search ..... 204/290 F, 291, 98, 204/128; 427/77, 125, 126.3, 126.5, 226, 229, 419.3, 404

[56] References Cited

U.S. PATENT DOCUMENTS 4,530,742 7/1985 Carlin ..... 204/290 F

FOREIGN PATENT DOCUMENTS 0121694 10/1984 European Pat. Off. .
0243302 10/1987 European Pat. Off. .
2007712 5/1979 United Kingdom .
2028871 3/1980 United Kingdom .

*Primary Examiner*—Kathryn Gorgos
*Attorney, Agent, or Firm*—Cushman, Darby & Cushman

[57] ABSTRACT

An electrode which comprises a substrate of a valve metal or an alloy thereof having properties similar to those of the valve metal and a coating comprising an outer layer which comprises $RuO_2$, an oxide of at least one non-noble metal and at least one other noble metal or oxide thereof and an intermediate layer having a composition different from that of the outer layer and which comprises $RuO_2$ and an oxide of at least one non-noble metal. The electrode is particularly useful as an anode for an electrolytic cell, eg a chlor-alkali cell, it has a lifetime therein which is greater than the sum of the operational life-times of electrodes which comprise a valve metal substrate and which separately comprise one of the above layers which together form a part of the coating of that electrode.

18 Claims, No Drawings

ELECTRODE COMPRISING A COATED VALVE METAL SUBSTRATE

BACKGROUND OF THE INVENTION

This invention relates to an electrode for use in an electrolytic cell, more particularly to an electrode for use as an anode in an electrolytic cell, especially in an electrolytic cell in which in operation chlorine is evolved at the anode, although use of the anode of the invention is not restricted to electrolyses in which chlorine is evolved.

Electrolytic processes are practised on a large scale throughout the world. For example, there are many industrial processes in which water or an aqueous solution is electrolyzed, for example, an aqueous solution of an acid or an aqueous solution of an alkali metal chloride. Aqueous acidic solutions are electrolyzed in, for example, electrowinning, electrotinning and electrogalvanizing processes, and aqueous alkali metal chloride solutions are electrolysed in the production of chlorine and alkali-metal hydroxide, alkali metal hypochlorite, and alkali metal chlorate. The production of chlorine and alkali metal hydroxide is practised in electrolytic cells which comprise a mercury cathode or in electrolytic cells which comprise a plurality of alternating anodes and cathodes, which are Generally of foraminate structure, arranged in separate anode and cathode compartments. These latter cells also comprise a separator, which may be a hydraulically permeable porous diaphragm or a substantially hydraulically impermeable ion-exchange membrane, positioned between adjacent anodes and cathodes thereby separating the anode compartments from the cathode compartments, and the cells are also equipped with means for feeding electrolyte to the anode compartments and if necessary liquid to the cathode compartments, and with means for removing the products of electrolysis from these compartments. In a cell equipped with a porous diaphragm, aqueous alkali metal chloride solution is charged to the anode compartments of the cell, and chlorine is discharged from the anode compartments and hydrogen and cell liquor containing alkali metal hydroxide are discharged from the cathode compartments of the cell. In a cell equipped with an ion-exchange membrane, aqueous alkali metal chloride solution is charged to the anode compartments of the cell and water or dilute aqueous alkali metal hydroxide soluton to the cathode compartments of the cell, and chlorine and depleted aqueous alkali metal chloride solution are discharged from the anode compartments of the cell and hydrogen and alkali metal hydroxide are discharged from the cathode compartments of the cell.

Electrolytic cells are also used in the electolysis of non-aqueous electrolytes, and in order to effect electrosynthetic processes.

It is desirable to operate such electrolytic cells at as low a voltage as possible in order to consume as little electrical power as possible and in such a way that the component parts of the electrolytic cell are long lasting. In particular, it is desirable that the electrodes in the electrolytic cell should have a long lifetime.

In recent years, anodes which have been used in such electrolytic processes have comprised a substrate of titanium or of an alloy of titanium possessing properties similar to those of titanium and a coating of an electrocatalytically-active material on the surface of the substrate. An uncoated titanium anode could not be used in such an electrolytic process as the surface of the titanium would oxidize when anodically polarized, and the titanium would soon cease to function as an anode. The use of such a coating of electrocatalytically-active material is essential in order that the titanium shall continue to function as an anode. Examples of such electrocatalytically-active materials which have been used include metals of the platinum group, oxides of metals of the platinum group, mixtures of one or more such metals and one or more such oxides, and mixtures or solid solutions of one or more oxides of a platinum group metal and tin oxide or one or more oxides of a valve metal, that is one or more oxides of titanium, tantalum, zirconium, niobium, hafnium or tungsten.

However, it has been found that although such coated titanium anodes do have a reasonably long lifetime they do not have a lifetime which is as long as is desired, particularly when used in electrolytic processes in which chlorine is evolved at the anodes and especially in such processes which are operated under severe conditions.

SUMMARY OF THE INVENTION

The present invention provides an electrode which comprises a substrate of a valve metal and a coating on the substrate which comprises a plurality of layers of electrocatalytically-active material and which, when used as an anode in an electrolytic cell, particularly in an electrolytic cell in which chlorine is evolved at the anode, has a substantial operational lifetime. It is a surprising feature of our invention that the useful operational lifetime of the electrode is greater than the sum of the operational lifetimes of a plurality of electrodes each of which comprises a valve metal substrate and which separately comprise a single layer of the electrocatalytically-active materials which together form a part of the coating of the electrode of the invention. Thus, the layers of electrocatalytically-active material which form the coating of the electrode have a surprising synergistic effect.

According to the present invention, there is provided an electrode which comprises a substrate of a valve metal or of an alloy thereof and a coating comprising an outer layer which comprises $RuO_2$, an oxide of at least one non-noble metal and at least one other noble metal or oxide thereof and an intermediate layer having a composition different from that of the outer layer and which comprises $RuO_2$ and an oxide of at least one non-noble metal.

The possibility is not excluded of the coating of the electrode comprising further layers in addition to those specifically identified as the outer layer and the intermediate layer, but it will be described hereinafter with reference to a coating which consists of only the aforementioned intermediate and outer layers.

The layers in the coating are described as variously comprising $RuO_2$, an oxide of at least one other noble metal or oxide thereof and an oxide of at least one non-noble metal. Although the various oxides in the layers may be present as oxides per se, it is to be understood that the oxides in one or in both layers may together form a solid solution in which the oxides are not present as such. Thus, in the intermediate layer, the $RuO_2$ and the oxide of a non-noble metal may together form a solid solution, and in the outer layer the $RuO_2$, the oxide of the other noble metal, where present, and the oxide of the non-noble metal may together form a solid solution in which the oxides are not present as such.

In general, the electrode will be used in the electrolysis of aqueous electrolytes, and although the electrode of the invention is particularly suitable for use as an anode at which chlorine is evolved, the electrode is not restricted to such use. It may, for example, be used as an anode in the electrolysis of aqueous alkali metal chloride solution to produce alkali metal hypochlorite or alkali metal chlorate, or it may be used as an anode at which oxygen is evolved.

The surprising synergistic effect has already been referred to. Thus, the electrode of the invention generally has a useful operational lifetime which is Greater than the sum of the operational lifetimes of an electrode having a coating only of the intermediate layer and of an electrode having a coating only of the outer layer of the electrode of the invention; the thickness of the intermediate layer and the outer layer in the separate electrodes being the same as the thickness of these layers in the coating of the electrode Of the invention.

DESCRIPTION OF PREFERRED EMBODIMENTS

The substrate of the electrode comprises a valve metal or an alloy thereof. Suitable valve metals include titanium, zirconium, niobium, tantalum and tungsten, and alloys comprising one or more such valve metals and having properties similar to those of the valve metals. Titanium is a preferred valve metal as it is readily available and relatively inexpensive when compared with the other valve metals.

The substrate may consist essentially of valve metal or alloy thereof, or it may comprise a core of another metal, eg steel or copper, and an outer surface of a valve metal or alloy thereof.

The intermediate layer of the coating comprises $RuO_2$ and an oxide of at least one non-noble metal. The oxide of the non-noble metal may be, for example $TiO_2$, $ZrO_2$ or $Ta_2O_5$ or oxide of another valve metal. Alternatively, or in addition, the intermediate layer may comprise an oxide of a non-noble metal other than a valve metal, and tin is an example of such a non-noble metal. A preferred composition for the intermediate layer of the coating is a $RuO_2$ and $TiO_2$, or preferably a $RuO_2$ and $SnO_2$ composition, which may be in the form of a solid solution.

The intermediate layer of the coating will generally comprise at least 10 mole % of $RuO_2$ in order that the layer shall provide to the electrode a reasonable electrocatalytic effect and an acceptable electrical conductivity. On the other hand, the presence in the intermediate layer of an oxide of a non-noble metal assists in increasing the useful operational lifetime of the electrode, and for this reason, it is preferred that the intermediate layer comprises at least 10 mole % of oxide of a non-noble metal. Generally, the intermediate layer will comprise $RuO_2$ and oxide of a non-noble metal in proportions of 20:80 mole % to 80:20 mole %, preferably in proportions of 20:80 mole% to 70:30 mole %.

The operational lifetime of the electrode is dependent at least to some extent on the amount of the intermediate layer in the coating on the electrode. In general, the intermediate layer will be present at a loading of at least $5g/m^2$ of nominal electrode surface, preferably at least $10g/m^2$. In general, it will not be necessary for the intermediate layer to be present at a loading of greater than $50g/m^2$, preferably not greater than $25g/m^2$.

The outer layer of the coating comprises $RuO_2$, an oxide of at least one non-noble metal, and at least one other noble metal or oxide thereof. The oxide of the noble metal may be, for example, an oxide of one or more of Rh, Ir, Os, and Pd, and the oxide of the non-noble metal may be an oxide of one or more valve metals or of tin, as in the intermediate layer or antimony. Where the other noble metal is present in metallic form, it is preferably platinum; where it is present in oxide form it is preferably an iridium oxide, eg $IrO_x$. The $IrO_x$ is preferred as the oxide of the other noble metal as electrodes having a coating which has an outer layer containing $IrO_x$ generally have a particularly useful operational lifetime, particularly where chlorine is evolved at the electrode.

The outer layer of the coating will generally comprise at least 10 mole % in total of oxide of noble metal, including $RuO_2$, and in general, at least 10 mole % of each of the $RuO_2$ and of the other noble metal or oxide thereof. As with the intermediate layer, the presence in the outer layer of an oxide of a non-noble metal assists in increasing the useful operational lifetime of the electrode, and for this reason, it is preferred that the outer layer comprises at least 10 mole % of oxide of a non-noble metal, generally at least 20 mole.

The operational lifetime of the electrode is dependent at least to some extent on the amount of the outer layer in the coating of the electrode. However, we have found that a useful electrode may be produced even where the amount of this outer layer is low, and the outer layer may be present at a loading of as little as $1g/m^2$ of electrode surface, preferably at least $2g/m^2$. The loading of the outer layer of the coating will generally not be greater than $20g/m^2$.

The structure of the electrode, and of the electrolytic cell in which the electrode is used, will vary depending upon the nature of the electrolytic process which is to be effected using the electrode. For example, the nature and structure of the electrolytic cell and of the electrode will vary depending upon whether the electrolytic process is one in which oxygen is evolved at the electrode, eg as in an electrowinning process, an electroplating process, an electrogalvanized process or an electrotinning process, or one in which chlorine is evolved at the electrode, or one in which alkali metal chlorate or alklai metal hypochlorite is produced, as is the case where aqueous alkali metal chloride solution is electrolyzed. However, as the inventive feature does not reside in the nature or structure of the electrolytic cell nor of the electrode, there is no necessity for the cell or the electrode to be described in any detail. Suitable types and structures of electrolytic cells and of electrodes may be selected from the prior art depending on the nature of the electrolytic process. The electrode may for example, have a foraminate structure, as in a woven or unwoven mesh, or as in a mesh formed by slitting and expanding a sheet of valve metal or alloy thereof, although other electrode structures may be used.

Prior to application of the coating to the substrate, the substrate may be subjected to treatments which are also known in the art. For example, the surface of the substrate may be roughened in order to improve the adhesion of the subsequently applied coating and in order to increase the real surface area of the substrate. The surface may be roughened by sand-blasting the substrate. The surface of the substrate may also be cleaned and etched, for example by contacting the substrate with an acid, eg with an aqueous solution of oxalic acid or hydrochloric acid, and the acid-treated substrate may then be washed, eg with water, and dried.

The layers of the coating on the electrode may also be applied by methods which are well known in the art. For example, the intermediate layer may be formed by applying to the substrate a solution or dispersion of thermally decomposable compounds of ruthenium and of the non-noble metal in a liquid medium. Suitable compounds which are thermally decomposable to the oxides of ruthenium and of the non-noble metal include halides, nitrates, and organic compounds, and suitable liquid media include water and organic liquids, eg alcohols and carboxylic acids. The solution may be applied by, for example, spraying, brushing or by roller coating, or by immersing the substrate in the solution, and the thus coated substrate may be heated in order to evaporate the liquid medium and then further heated in order to decompose the decomposable compounds and form the oxides of ruthenium and of the non-noble metal. Heating up to a temperature of 800° C. will generally suffice. It may be necessary to repeat the coating and heating procedure one or more times in order to build up an intermediate layer having the required loading.

Similarly, the outer layer of the coating may be formed by applying to the intermediate layer a solution or dispersion of thermally decomposable compounds of ruthenium, of at least one other noble metal, and of at least one non-noble metal, heating the applied solution or dispersion, and repeating the application and heating steps as necessary to build up the required loading of the outer layer of the coating. Examples The invention is illustrated by the following examples.

EXAMPLE 1

This Example illustrates the superior life-time of an electrode according to the present invention.

A sheet of titanium was cleaned by contacting the sheet with trichloroethylene, the cleaned sheet was dried and then immersed in 10 weight % aqueous oxalic acid solution at 85° C. for 8 hours, the sheet was removed from the solution and washed in deionized water, and finally the sheet was dried.

INTERMEDIATE LAYER

A solution of 2.21 g of $RuCl_3$ hydrate and 9.7 g of tetra-n-butyl titanate in 30 ml of n-pentanol was applied by brush to the titanium sheet and the thus coated sheet was heated in an oven at 180° C. for 10 minutes to remove the n-pentanol from the coating and then the sheet was fired in an oven in air at 450° C. for 20 minutes in order to decompose the $RuCl_3$ hydrate and the tetra n-butyl titanate to $RuO_2$ and $TiO_2$, respectively. The coating, heating and firing procedure was repeated until a loading of 20 g/m$^2$ of the intermediate coating was achieved.

OUTER LAYER

A solution of 1.5 g of $RuCl_3$ hydrate, 6.2 g of stannous octoate, and 0.63 g of chlor-iridic acid ($H_2IrCl_6$) in 30 ml of n-pentanol was applied by brush to the intermediate coating, and then this applied coating was heated and fired following the above described procedure except that the firing temperature was 510° C. The coating, heating and firing procedure was repeated until a loading of 4 g/m$^2$ of the outer layer was achieved.

The intermediate layer and the outer layer had the following compositions in weight %

| Intermediate | | Outer | |
|---|---|---|---|
| $RuO_2$ | 35 | $RuO_2$ | 25 |
| $TiO_2$ | 65 | $IrO_X$ | 10 |
| | | $SnO_2$ | 65 |

The thus coated titanium sheet was installed in an electrolytic cell as an anode and spaced from a nickel cathode and the anode was subjected to an accelerated wear test in which an aqueous solution containing 20 weight % NaCl and 20 weight % NaOH was electrolysed at a constant current density of 20 kA/m$^2$ and at a temperature of 65° C.

The initial anode-cathode voltage was 4 volts, and the voltage was monitored throughout the test. The lifetime of the anode was considered to be the time taken for the voltage to rise by 2 volts over the initial voltage. The life-time of the anode was found to be 99 hours.

In Comparative Tests, the above described procedure was repeated to produce two electrodes in which respectively, the coating on the surface of the titanium substrate consisted of 20 g/m$^2$ of a coating consisting of $RuO_2$ and $TiO_2$ in the same proportions as in the intermediate layer in Example 1, and 4 g/m$^2$ of a coating consisting of $RuO_2$, $IrO_x$ and $SnO_2$ in the same proportions as in the outer layer in Example 1.

The lifetimes of these electrodes were, respectively, 33 hours and 39 hours. Accordingly, it would be expected that a titanium substrate coated with both these, layers would have an operational life-time, of not more than 72 hours. Surprisingly, as can be seen from Example 1 above, such a coated electrode has an operational life-time of 99 hours.

EXAMPLES 2-8

These Examples illustrate further electrodes according to the present invention.

The procedure used for the preparation of the intermediate layer in Example 1 was repeatd except that instead of the solution of 2.21 g ruthenium trichloride hydrate and 9.7 g tetra-n-butyl titanate in 30 ml n-pentanol, the components shown in Table 1 were used. In Example 6, firing was carried out at 510° C.

A thickness of about 2 g/m$^2$/coat was obtained and this procedure was repeated until the desired thickness of intermediate layer was achieved.

TABLE 1

| EX NO | $RuCl_3 \times H_2O$ (g) | NON-NOBLE METAL PRECURSOR (g) | PENTANOL |
|---|---|---|---|
| 2-5, 7, 8 | 2.93 | TBT(12.9) | 40 |
| 6 | 1.81 | SO(6.7) | 30 |

TBT: tetra-n-butyl titanate
SO: stannous octoate

For the preparation of the outer layer: in Examples 3 and 6, the procedure used for the preparation of the outer layer in Example 1 was repeated; and in Examples 2,4,5,7 and 8, the procedure used for the preparation of the outer layer in Example 1 was repeated except that instead of the solution of 1.15 g ruthenium trichloride hydrate, 6.2 g stannous octoate and 0.63 g chlor-iridic acid in 30 ml of n-pentanol, the components shown in Table 2 were used, and in Example 2, firing was carried out at 450° C.

A thickness of about 2 g/m²/coat was obtained and this procedure was repeated until the desired thickness of outer layer was achieved.

TABLE 2

| EX NO | $RuCl_3 \times H_2O$ (g) | NON-NOBLE METAL PRE-CURSOR (g) | NOBLE METAL PRECURSOR (g) | PEN-TANOL (ml) |
|---|---|---|---|---|
| 2 | 2.93 | TBT (10.2) | CIIA (0.79) | 30 |
| 4 | 0.4 (5.2) | SO (0.4) | CIIA | 20 |
| 5 | 0.96 (3.1 g) | SO (1.04) | CIAA | 20 |
| 7 | 0.99 (4.2) | SO (0.55) | $H_2PtCl_6$ | 20 |
| 8 | 0.98 | SO (4.13) | $RhCl_3$ | 20 |

TBT: tetra-n-butyl titanate
SO: stannous octoate
CIIA: chlor-iridic acid

The compositions of the intermediate layers and the outer layers are shown in Table 3.

The life-times of these electrodes, determined by the accelerated wear test described in Example 1 are shown in Table 3.

TABLE 3

| Example | COATING | | | | | | | | | | | |
|---|---|---|---|---|---|---|---|---|---|---|---|---|
| | INTERMEDIATE LAYER COMPOSITION (% W/W) | | | | OUTER LAYER COMPOSITION (% W/W) | | | | | | | LIFE-TIME |
| No | A | $RuO_2$ | $TiO_2$ | $SnO_2$ | A | $RuO_2$ | $IrO_2$ | Pt | $RH_2O_3$ | $TiO_2$ | $SnO_2$ | (HRS) |
| 2 | 10 | 35 | 65 | 0 | 4 | 25 | 10 | 0 | 0 | 65 | 0 | 46 |
| 3 | 10 | 35 | 65 | 0 | 4 | 25 | 10 | 0 | 0 | 0 | 65 | 77 |
| 4 | 10 | 35 | 65 | 0 | 4 | 10 | 10 | 0 | 0 | 0 | 80 | 72 |
| 5 | 10 | 35 | 65 | 0 | 4 | 25 | 25 | 0 | 0 | 0 | 50 | 146 |
| 6 | 10 | 30 | 0 | 70 | 4 | 25 | 10 | 0 | 0 | 0 | 65 | 161 |
| 7 | 10 | 35 | 65 | 0 | 4 | 25 | 0 | 10 | 0 | 0 | 65 | 49 |
| 8 | 10 | 35 | 65 | 0 | 4 | 25 | 0 | 0 | 10 | 0 | 65 | 74 |

We claim:

1. An electrode which comprises a substrate of a valve metal or an alloy thereof having properties similar to those of the valve metal and a coating comprising an outer layer which comprises $RuO_2$, an oxide of at least one non-noble metal and at least one other noble metal or oxide thereof and an intermediate layer having a composition different from that of the outer layer and which comprises $RuO_2$ and an oxide of at least one non-noble metal wherein the ruthenium oxide provides a minor portion of at least one of the intermediate layer and the outer layer.

2. An electrode which comprises a substrate of a valve metal or an alloy thereof having properties similar to those of the valve metal and a coating comprising an outer layer which comprises $RuO_2$, an oxide of at least one non-noble metal and at least one other noble metal or oxide thereof and an intermediate layer having a composition different from that of the outer layer and which comprises $RuO_2$ and an oxide of at least one non-noble metal wherein the loading of the outer layer is less than the loading of the intermediate layer.

3. An electrode as claimed in claim 1 or 2 wherein the valve metal is titanium.

4. An electrode as claimed in claim 1 or 2 wherein the non-noble metal oxide of which the intermediate layer is comprised is an oxide of titanium or tin.

5. An electrode as claimed in claim 3 wherein the oxide of the non-noble metal is an oxide of tin.

6. An electrode as claimed in claim 1 or 2 wherein the oxide of the non-noble metal of which the intermediate layer is comprised provides at least 10 mole% of the intermediate layer.

7. An electrode as claimed in claim 1 or 2 wherein the intermediate layer is present at a loading of at least 10 g/m² of electrode surface.

8. An electrode as claimed in claim 7 wherein the intermediate layer is present at a loading of not greater than 25 g/m² of electrode surface.

9. An electrode as claimed in claim 1 or 2 wherein the oxide of the non-noble metal of which the outer layer is comprised is an oxide of tin, titanium, or antimony.

10. An electrode as claimed in claim 1 or 2 wherein the oxide of the non-noble metal of which the outer layer is comprised provides at least 10 mole% of the outer layer.

11. An electrode as claimed in claim 1 or 2 wherein the outer layer is present at a loading of at least 2 g/m² of electrode surface.

12. An electrode cell comprising an electrode as claimed in claim 1 or 2.

13. A process for the preparation of an electrode as claimed in claim 1 or 2 which process comprises the steps of forming the intermediate coating on the substrate and then the outer coating thereon.

14. A process as claimed in claim 13 wherein the intermediate layer or outer layer or both is formed by applying a solution or dispersion of appropriate thermally decomposable compounds to the substrate or intermediate layer and heating the applied solution or dispersion to decompose the thermally decomposable compound(s).

15. A process for the electrolysis of an aqueous electrolyte wherein at least one of the electrodes is an electrode as claimed in claim 1 or 2.

16. A process as claimed in claim 15 wherein the at least one of the electrodes is an anode.

17. An electrode which comprises a substrate of a valve metal or an alloy thereof having properties similar to those of the valve metal and a coating comprising an outer layer which comprises $RuO_2$, an oxide of at least one non-noble metal and at least one other noble metal or oxide thereof and an intermediate layer having a composition different from that of the outer layer and which comprises $RuO_2$ and an oxide of at least one non-noble metal, wherein the oxide of the other noble metal of which the outer layer is comprised is an oxide of iridium.

18. An electrode which comprises a substrate of a valve metal or an alloy thereof having properties similar to those of the valve metal and a coating comprising an outer layer which comprises $RuO_2$, an oxide of at least one non-noble metal and at least one other noble metal or oxide thereof and an intermediate layer having a composition different from that of the outer layer and which comprises $RuO_2$ and an oxide of at least one non-noble metal, wherein the other noble metal of which the outer layer is comprised is platinum.

* * * * *